United States Patent [19]

Orillion

[11] 4,349,457

[45] Sep. 14, 1982

[54] CORROSION PROTECTION FOR METAL SURFACES

[75] Inventor: Michael T. Orillion, Baton Rouge, La.

[73] Assignee: The Dow Chemical Co., Midland, Mich.

[21] Appl. No.: 273,817

[22] Filed: Jun. 15, 1981

Related U.S. Application Data

[62] Division of Ser. No. 128,767, Mar. 10, 1980, Pat. No. 4,298,657.

[51] Int. Cl.[3] ..... C23F 11/18; C23F 15/00; B32B 15/08

[52] U.S. Cl. ..... 252/389 R; 106/14.44; 252/387; 428/416; 428/418; 428/469; 428/697; 422/7; 422/8

[58] Field of Search ..... 252/389 R, 387; 106/14.44; 422/7, 8; 428/416, 418, 469, 697

[56] References Cited

U.S. PATENT DOCUMENTS

| | | | |
|---|---|---|---|
| 3,030,308 | 4/1962 | Agnew et al. | 252/387 |
| 3,035,005 | 5/1962 | Sampson | 252/387 |
| 4,132,667 | 1/1979 | Kerfoot | 252/387 |
| 4,313,837 | 2/1982 | Vukasovich | 252/387 |

*Primary Examiner*—Irwin Gluck
*Attorney, Agent, or Firm*—A. J. Young

[57] ABSTRACT

Corrosion-inhibitor compositions and protective covers for the protection of metal surfaces against corrosion, particularly at elevated temperatures. A preferred method is the dispositon of the corrosion-inhibitor compositions in or on the metal-contacting surface of the thermal insulation. The composition of the corrosion inhibitor comprises borate, nitrite, and molybdate salts; and may further include an epoxy resin binder, an epoxy resin hardener, and a thinning agent.

6 Claims, No Drawings

CORROSION PROTECTION FOR METAL SURFACES

CROSS-REFERENCE TO RELATED APPLICATION

This is a divisional, of application Ser. No. 128,767, filed Mar. 10, 1980.

BACKGROUND OF THE INVENTION

This invention relates to materials and methods for the corrosion protection of metal surfaces. More particularly, this invention relates to the use of thermal insulation impregnated with an inhibitor composition useful for the protection of metal surfaces against corrosion.

It is known to protect metal surfaces against corrosion by the use of corrosion inhibitors. It is likewise known that such inhibitors may be incorporated into thermal insulation covering the metal surfaces. However, the use of a molybdate salt as one of the constituents of a composition so impregnated in the insulation is unknown and has been surprisingly found to be very effective. It has been further discovered that, by the use of a molybdate salt, the inclusion of an alkali carbonate or its equivalent in inhibitor compositions may be entirely eliminated. Corrosion inhibitors prepared in accordance with this invention are entirely compatible with common insulation materials.

SUMMARY

In general, this invention provides a corrosion protection cover for metal surfaces, comprising: (a) thermal insulation, to reduce the flow of heat between the metal surface and its surroundings; and (b) a composition useful for the corrosion-protection of metal surfaces, disposed in or on the metal-contacting surface of the thermal insulation, which includes a borate salt of an alkali metal, a nitrite salt of an alkali metal, and a molybdate salt of an alkali metal. The invention likewise provides compositions useful for corrosion protection, whether disposed on the metal-contacting surface of or within the thermal insulation or applied to the metal surface by one or more of several means well-known to the art.

It is an object of the present invention to provide compositions for the more efficient protection of metal surfaces against corrosion. A further object is to provide thermal insulation for such metal surfaces which includes a corrosion-protection composition impregnated therein, thereby providing protection against corrosion at elevated temperatures. Other objects of this invention will be apparent to those skilled in the art from the more detailed description which follows.

DESCRIPTION OF THE PREFERRED EMBODIMENTS

The following description illustrates the manner in which the principles of the invention are applied but is not to be construed as limiting the scope of the invention.

Preferably, corrosion inhibitors prepared and used in accordance with this invention comprise compositions which include the sodium salts of borate, nitrite, and molybdate. These compositions may further include an epoxy resin, an epoxy hardener, and a thinning agent. The epoxy resin and thinning agent serve as a binder and application vehicle, respectively, for the inhibitors. Most preferably, the borate used is borax. The epoxy resin may also contain between about forty percent and about sixty percent zinc chromate by weight.

In a further preferred embodiment of the present invention, the corrosion-inhibitor composition comprises between about ten and about fifty parts by weight of borax, between about twenty and about two-hundred parts by weight of sodium nitrite, between about twenty and about two-hundred parts by weight of sodium molybdate, between about one-hundred and about fifteen-hundred parts by weight of an epoxy resin, between about one-hundred and about six-hundred parts by weigh of an epoxy hardener, and between about one-hundred and about one-thousand parts by weight of a thinning agent. The preferred thinning agent comprises a mixture of diacetone alcohol, methylisobutyl ketone and toluene.

In another preferred embodiment, the corrosion-inhibitor composition comprises between about twenty and about forty parts by weight of borax, between about fifty and about two-hundred parts by weight of sodium nitrite, and between about fifty and about two-hundred parts by weight of sodium molybdate.

In a preferred method of practicing this invention, the corrosion inhibitor compositions just described are impregnated in or disposed on the metal-contacting surface of the thermal insulation by well-known means such as soaking, brushing or spraying. The thermal insulation is most preferably fiberglass, foamglass, or calcium silicate. The thermal insulation, including the inhibitor compsitions, is then applied to the metal surface to be protected by using well-known techniques. In utilizing this embodiment of the invention, the metal surfaces may thereby be protected against corrosion at relatively high temperatures.

The corrosion-inhibitor compositions may also be applied directly to the metal surface which is to be protected by well-known means such as brushing or spraying and thereafter left bare or covered with insulation. However, if the metal surface is to be left bare, the inhibitor compositions should include the epoxy-resin binder to insure retention of the inhibitors on the metal surface.

This invention is further illustrated by the following examples, in which three sets of carbon-steel pipe were subjected to a corrosion environment with and without the protection of a corrosion-inhibitor composition prepared according to this invention. One set of pipes was tested without any type of pre-conditioning, a second set was pre-conditioned by sandblasting, and a third set was zinc-primed. Thereafter one-foot lengths of each specimen were wrapped in fire-clad paper wherein holes and open seams were preset to permit penetration of moisture. The specimens were then exposed to outdoor weather conditions.

EXAMPLE 1

The corrosion-inhibitor composition was prepared from forty grams of borax, two-hundred grams of sodium nitrite, two-hundred grams of sodium molybdate, twelve-hundred milliliters of an epoxy resin containing about fifty percent zinc chromate by weight, six-hundred milliliters of an epoxy hardener, and one-thousand milliliters of a thinning agent which comprised a mixture of diacetone alcohol, methylisobutyl ketone, and toluene. This composition was applied by brush to several of the steel pipe specimens; and also applied by brush to several sets of fiberglass, foamglass, and calcium silicate. These coated insulation materials were then used to insulate other specimens of steel pipe.

EXAMPLE 2

A corrosion inhibitor composition was prepared from twenty grams of borax, fifty grams of sodium nitrite, fifty grams of sodium molybdate, three-hundred milliliters of an epoxy resin, one-hundred-fifty milliliters of an epoxy hardener, and one-hundred-fifty milliliters of a thinning agent which comprised a mixture of diacetone alcohol, methylisobutyl ketone and toluene. This composition was applied to six sections of sandblasted carbon-steel pipe and to six sections of fiberglass insulation, which were thereafter used to insulate six other sections of pipe. The composition was applied by brush to the exterior of the pipe and to the inside surface of the insulation.

EXAMPLE 3

A corrosion inhibitor composition was prepared from thirty grams of borax, one-hundred grams of sodium nitrite, one-hundred grams of sodium molybdate, and seven-thousand milliliters of water. Several sections of fiberglass insulation were immersed in the composition and then dried in an oven. Thereafter the fiberglass insulation was used to insulate several sections of steel pipe.

EXAMPLE 4

A corrosion inhibitor composition was prepared from ten grams of borax, twenty grams of sodium nitrite, twenty grams of sodium molybdate, five-hundred-fifty milliliters of an epoxy resin, two-hundred-seventyfive milliliters of an epoxy hardener, and two-hundred milliliters of a thinning agent which comprised a mixture of diacetone alcohol, methylisobutyl ketone, and toluene. In applying this composition to carbon-steel pipe, three sections of pipe were first sandblasted prior to applying the composition. Thereafter, two sections of pipe were coated with the composition by brush and one section was left untreated for testing.

The specimens in Examples 1 through 4 were examined for evidence of corrosion after one month, after six months, and after one year. Those specimens not protected by application of the corrosion inhibitor compositions specified in Examples 1 through 4 were in all cases found to display evidence of corrosion attack. The degree of severity was observed to increase as the time of exposure increased from one month to six months to one year.

In significant contrast, the specimens that had been protected by application of the corrosion-inhibitor compositions specified in Examples 1 through 4 showed little or no evidence of corrosive attack. There was, in fact, no significant evidence of any surface corrosion after one month for the protected specimens. After six months and even after a year these specimens showed very little or no surface corrosion. Where slight indications of surface corrosion were found for the protected specimens, such corrosion was very slight and in all cases substantially less than for any of the untreated specimens.

While certain representative embodiments and details have been shown for the purpose of illustrating the invention, it will be apparent to those skilled in the art that various changes and modifications can be made therein without departing from the spirit and scope of the invention.

What is claimed is:

1. A composition useful for the corrosion-protection of metal surfaces, comprising: a borate salt of an alkali metal, a nitrite salt of an alkali metal, and a molybdate salt of an alkali metal.

2. The composition of claim 1, which further includes an epoxy resin, an epoxy resin hardener, and a thinning agent.

3. The composition of claim 1 or claim 2, wherein the alkali metal is sodium and the borate salt is borax.

4. The composition of claim 2, wherein the composition comprises between about ten and about fifty parts of borax by weight, between about twenty and about two-hundred parts by weight of sodium nitrite, between about twenty and about two-hundred parts by weight of sodium molybdate, between about one-hundred and about fifteen-hundred parts by weight of epoxy resin, between about one-hundred and about six-hundred parts by weight of epoxy resin hardener, and between about one-hundred and about one-thousand parts by weight of a thinning agent.

5. The composition of claim 1, wherein the composition comprises between about twenty and about forty parts by weight of borax, between about fifty and about two-hundred parts by weight of sodium nitrite, and between about fifty and about two-hundred parts by weight of sodium molybdate.

6. The composition of claim 5, wherein the epoxy resin contains between about forty percent and about sixty percent zinc chromate by weight.

* * * * *